US009715848B2

(12) United States Patent
Kim et al.

(10) Patent No.: US 9,715,848 B2
(45) Date of Patent: Jul. 25, 2017

(54) ORGANIC LIGHT EMITTING DISPLAY DEVICE AND METHOD FOR DRIVING THEREOF

(71) Applicant: LG Display Co., Ltd., Seoul (KR)

(72) Inventors: Hyung Rae Kim, Gyeonggi-do (KR); Seung Chan Byun, Gyeonggi-do (KR); Jung Yoon Yi, Gyeonggi-do (KR); Kyoung Sik Choi, Daejeon (KR); Dae Hyeon Park, Gyeongsangbuk-do (KR); Ui Taek Jeong, Seoul (KR); Boeon Byeon, Gwangju (KR)

(73) Assignee: LG Display Co., Ltd., Seoul (KR)

( * ) Notice: Subject to any disclaimer, the term of this patent is extended or adjusted under 35 U.S.C. 154(b) by 381 days.

(21) Appl. No.: 14/102,760

(22) Filed: Dec. 11, 2013

(65) Prior Publication Data

US 2014/0168039 A1 Jun. 19, 2014

(30) Foreign Application Priority Data

Dec. 17, 2012 (KR) ..... 10-2012-0147930

(51) Int. Cl.
*G09G 3/32* (2016.01)
*G09G 3/3208* (2016.01)
(Continued)

(52) U.S. Cl.
CPC ..... *G09G 3/3208* (2013.01); *G09G 3/3233* (2013.01); *G09G 3/3275* (2013.01); *G09G 2300/0842* (2013.01); *G09G 2320/043* (2013.01); *G09G 2320/048* (2013.01); *G09G 2360/16* (2013.01)

(58) Field of Classification Search
CPC ... G09G 3/3208; G09G 3/3233; G09G 3/3275
See application file for complete search history.

(56) References Cited

U.S. PATENT DOCUMENTS

2003/0063053 A1 4/2003 Yamazaki et al.
2005/0110728 A1 5/2005 Cok
(Continued)

FOREIGN PATENT DOCUMENTS

JP 2002258792 A 9/2002
JP 2003-228329 A 8/2003
(Continued)

*Primary Examiner* — Claire X Pappas
*Assistant Examiner* — Robert Stone
(74) *Attorney, Agent, or Firm* — Morgan, Lewis & Bockius LLP

(57) ABSTRACT

An organic light emitting display device includes a display panel having a plurality of sub-pixels; a memory configured to accumulate and store data displayed by each sub-pixel; and a panel driver configured to: calculate a degradation compensation gain value for increasing or decreasing a luminance of each sub-pixel based on accumulated data of each sub-pixel stored in the memory, generate modulated data of each sub-pixel by modulating input data to each sub-pixel according to the calculated degradation compensation gain value, convert the modulated data into a data voltage, and accumulate the modulated data from the accumulated data of the corresponding sub-pixel and then store the data in the memory.

18 Claims, 7 Drawing Sheets

(51) Int. Cl.
*G09G 3/3233* (2016.01)
*G09G 3/3275* (2016.01)

(56) References Cited

U.S. PATENT DOCUMENTS

| | | | | |
|---|---|---|---|---|
| 2006/0022914 | A1 | 2/2006 | Kimura et al. | |
| 2006/0279490 | A1 | 12/2006 | Park et al. | |
| 2007/0273701 | A1 | 11/2007 | Mizukoshi et al. | |
| 2009/0147032 | A1 | 6/2009 | Kim | |
| 2011/0205202 | A1* | 8/2011 | Son | G09G 3/3208 345/207 |
| 2012/0056916 | A1* | 3/2012 | Ryu et al. | 345/690 |
| 2012/0154683 | A1 | 6/2012 | Yamashita et al. | |
| 2012/0212516 | A1* | 8/2012 | Ahn | G09G 3/3233 345/690 |
| 2012/0256971 | A1* | 10/2012 | Shin et al. | 345/77 |
| 2014/0118426 | A1* | 5/2014 | Chun | G09G 3/3208 345/691 |

FOREIGN PATENT DOCUMENTS

| | | | |
|---|---|---|---|
| JP | 2005-275182 | A | 10/2005 |
| JP | 2006195312 | A | 7/2006 |
| JP | 2006201631 | A | 8/2006 |
| JP | 2007187761 | A | 7/2007 |
| JP | 2007-286294 | A | 11/2007 |
| JP | 2012128148 | A | 7/2012 |

* cited by examiner

ORGANIC LIGHT EMITTING DISPLAY DEVICE AND METHOD FOR DRIVING THEREOF

CROSS REFERENCE TO RELATED APPLICATIONS

This application claims the benefit of priority of Korean Patent Application No. 10-2012-0147930 filed on Dec. 17, 2012, which is hereby incorporated by reference as if fully set forth herein.

BACKGROUND

Field of the Disclosure

Embodiments relate to an organic light emitting display device and a method for driving the same, for example, to an organic light emitting display device which enables compensating the degradation of an organic light emitting diode, and a method for driving the same.

Discussion of the Related Art

According to recent developments in multimedia, there is increasing demand for flat panel displays. To satisfy this increasing demand, various flat panel displays such as liquid crystal display devices, plasma display panels, field emission display devices and organic light emitting display devices are used in practice. Among the various flat panel displays, the organic light emitting display device has been attractive as a next-generation flat panel display owing to advantages of rapid response speed and low power consumption. In addition, the organic light emitting display can emit light by itself, whereby the organic light emitting display does not have the problems associated with a narrow viewing angle.

Generally, the organic light emitting display device may include a display panel having a plurality of pixels, and a panel driver for driving the respective pixels so as to make the respective pixels emit light. In this case, the pixels may be respectively formed in pixel regions, wherein the pixel regions may be defined by the crossing of a plurality of gate lines and a plurality of data lines.

With reference to FIG. 1, each pixel may include a switching transistor (Tsw), a driving transistor (Tdr), a capacitor (Cst), and an organic light emitting diode (OLED).

As the switching transistor (Tsw) is switched on by a gate signal (GS) supplied to a gate line (GL), a data voltage (Vdata) supplied to a data line (DL) may be supplied to the driving transistor (Tdr).

As the driving transistor (Tdr) is switched by the data voltage (Vdata) supplied from the switching transistor (Tsw), it is possible to control a data current (Ioled) flowing to the organic light emitting diode (OLED) by a driving voltage (VDD) (e.g., a first power supply voltage).

The capacitor (Cst) may be connected between gate and source terminals of the driving transistor (Tdr), wherein the capacitor (Cst) may store a voltage corresponding to the data voltage (Vdata) supplied to the gate terminal of the driving transistor (Tdr), and may turn on the driving transistor (Tdr) by the use of this stored voltage.

The organic light emitting diode (OLED) may be electrically connected between the source terminal of the driving transistor (Tdr) and a cathode electrode supplied with a cathode voltage (VSS) (e.g., a second power supply voltage), wherein the organic light emitting diode (OLED) may emit light by the flow of data current (Ioled) supplied from the driving transistor (Tdr).

Each pixel of the organic light emitting display device according to the related art may control an intensity of the data current (Ioled) flowing to the organic light emitting diode (OLED) by the driving voltage (VDD) through the use of switching of the driving transistor (Tdr) according to the data voltage (Vdata), whereby the organic light emitting diode (OLED) emits light and thereby displays an image.

FIG. 2 is a graph illustrating luminance change in accordance with driving time of the organic light emitting diode (OLED) according to the related art.

As shown in FIG. 2, the organic light emitting diode (OLED) may degrade as driving time increases, which gradually deteriorates the luminance characteristics. Thus, the organic light emitting display device according to the related art may have problems of lowered luminance and luminance deviation due to the degradation of the organic light emitting diode (OLED).

SUMMARY

Accordingly, present embodiments may be directed to an organic light emitting display device and a method for driving the same that substantially obviates one or more problems due to limitations and disadvantages of the related art.

An aspect of embodiments is to provide an organic light emitting display device which facilitates decreased luminance lowering and luminance deviation caused by the degradation of organic light emitting diodes (OLEDs), and a method for driving the same.

Additional advantages and features of the embodiments will be set forth in part in the description which follows and in part will become apparent to those having ordinary skill in the art upon examination of the following or may be learned from practice of the embodiments. The objectives and other advantages of the embodiments may be realized and attained by the structure particularly pointed out in the written description and claims hereof as well as the appended drawings.

To achieve these and other advantages and in accordance with the purpose of the invention, as embodied and broadly described herein, there is provided a an organic light emitting display device that may include a display panel having a plurality of sub-pixels, wherein each sub-pixel has an organic light emitting diode which emits light by a data current based on a data voltage; a memory which accumulates and stores data displayed in each sub-pixel; and a panel driver which calculates a degradation compensation gain value for increasing or decreasing a luminance of each sub-pixel on the basis of accumulated data of each sub-pixel stored in the memory, generates modulated data of each sub-pixel by modulating input data to be supplied to each sub-pixel in accordance with the calculated degradation compensation gain value, converts the modulated data into the data voltage, and accumulates the modulated data on the accumulated data of the corresponding sub-pixel and then stores the data obtained by accumulation in the memory.

In another aspect of an embodiment of the present invention, there is provided a method for driving an organic light emitting display device provided with a display panel having a plurality of sub-pixels, wherein each sub-pixel has an organic light emitting diode which emits light by a data current based on a data voltage, that may include (A) step of calculating a degradation compensation gain value for increasing or decreasing a luminance of each sub-pixel on the basis of accumulated data of each sub-pixel stored in a memory, generating modulated data of each sub-pixel by modulating input data to be supplied to each sub-pixel in accordance with the calculated degradation compensation gain value, accumulating the modulated data on the accumulated data of the corresponding sub-pixel, and storing the data obtained by accumulation in the memory; and (B) step of converting the modulated data of each sub-pixel into the data voltage, and supplying the data voltage to each sub-pixel.

It is to be understood that both the foregoing general description and the following detailed description of the present embodiments are exemplary and explanatory and are intended to provide further explanation of the invention as claimed.

BRIEF DESCRIPTION OF THE DRAWINGS

The accompanying drawings, which are included to provide a further understanding of the present embodiments and are incorporated in and constitute a part of this application, illustrate examples of the embodiment(s) and together with the description serve to explain principles in accordance with the invention. In the drawings.

DETAILED DESCRIPTION

Reference will now be made in detail to example embodiments, some of which are illustrated in the accompanying drawings. The same or similar reference numbers may be used throughout the drawings to refer to the same or like parts.

The following details about some terms should be understood.

The term of a singular expression should be understood to include a multiple expression as well as the singular expression if there is no specific definition in the context. If using the term such as "the first" or "the second", it is to separate any one element from other elements. Thus, a scope of claims is not limited by these terms.

Also, it should be understood that the term such as "include" or "have" does not preclude existence or possibility of one or more features, numbers, steps, operations, elements, parts or their combinations.

It should be understood that the term "at least one" includes all combinations related with any one item. For example, "at least one among a first element, a second element and a third element" may include all combinations of the two or more elements selected from the first, second and third elements as well as each element of the first, second and third elements.

Hereinafter, an organic light emitting display device according to embodiments and a method for driving the same will be described in detail with reference to the accompanying drawings.

Figure 3:
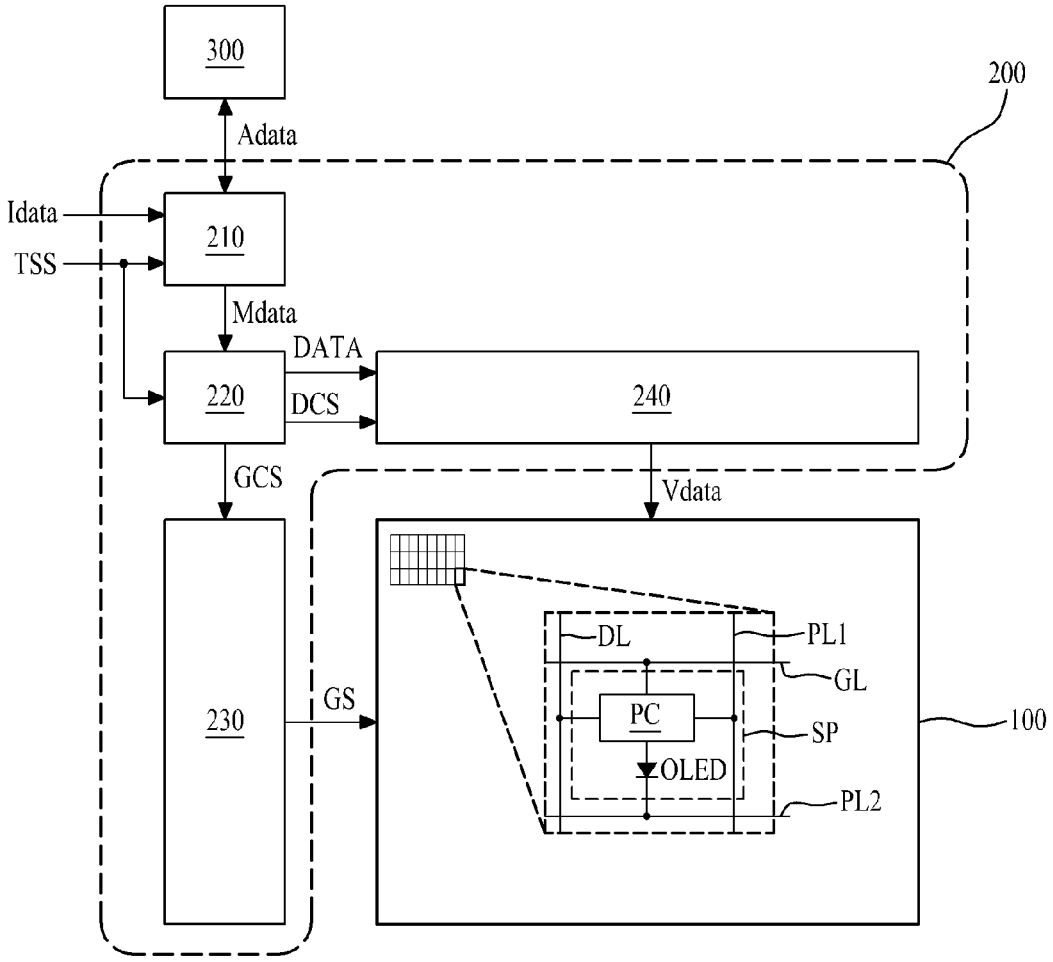
FIG. 3 illustrates an organic light emitting display device according to an embodiment.

FIG. 3 illustrates an organic light emitting display device according to an embodiment.

With reference to FIG. 3, the organic light emitting display device according to an embodiment may include a display panel 100, a panel driver 200, and a memory 300.

The display panel 100 may include a plurality of sub-pixels (SP). The plurality of sub-pixels (SP) may be formed in pixel regions defined by the crossing of a plurality of gate lines (GL) and a plurality of data lines (DL). On the display panel 100, there may be a plurality of driving voltage lines (PL1) that are supplied with a driving voltage from the panel driver 200, wherein the plurality of driving voltage lines (PL1) may be respectively formed in parallel to the plurality of data lines (DL).

Each of the sub-pixels (SP) may be any one among red, green, blue, and white sub-pixels. A unit pixel for displaying an image may comprise adjacent red, green, blue, and white sub-pixels, or may comprise adjacent red, green, and blue sub-pixels.

Each of the sub-pixels (SP) may include an organic light emitting diode (OLED) and a pixel circuit (PC).

The organic light emitting diode (OLED) may be connected between the pixel circuit (PC) and a second power source line (PL2). The organic light emitting diode (OLED) may emit light in proportion to an amount of data current supplied from the pixel circuit (PC), and may emit light with a predetermined color. To this end, the organic light emitting diode (OLED) may include an anode electrode (or pixel electrode) connected to the pixel circuit (PC), a cathode electrode (or reflective electrode) connected to the second power source line (PL2), and a light emitting cell formed between the anode electrode and the cathode electrode, wherein the light emitting cell may emit any one of red-colored light, green-colored light, blue-colored light, and white-colored light. The light emitting cell may, for example, be formed in a deposition structure of hole transport layer/organic light emitting layer/electron transport layer, or a deposition structure of hole injection layer/hole transport layer/organic light emitting layer/electron transport layer/electron injection layer. Furthermore, the light emitting cell may include a functional layer for improving light-emitting efficiency and/or lifespan of the organic light emitting layer.

Figure 1:
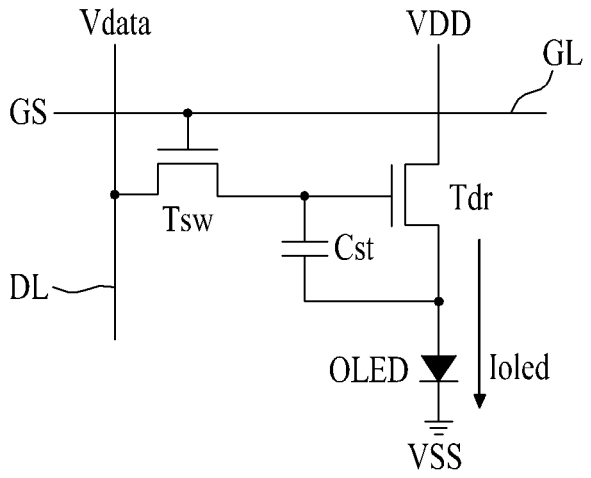
FIG. 1 Related Art
FIG. 1 illustrates a pixel structure of an organic light emitting display device according to the related art.
Figure 2:
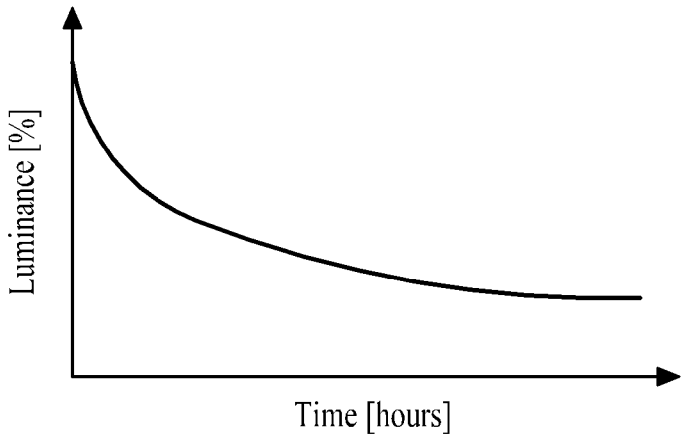
FIG. 2 Related Art
FIG. 2 is a graph illustrating a luminance change in accordance with driving time of an organic light emitting diode (OLED) according to the related art.

The pixel circuit (PC) may supply the data current, which corresponds to the data voltage (Vdata) supplied from the panel driver 200 to the data line (DL) in response to a gate signal (GS) of a gate-on voltage level supplied from the panel driver 200 to the gate line (GL), to the organic light emitting diode (OLED). The data voltage (Vdata) may have a voltage value obtained by compensating the degradation characteristics of the organic light emitting diode (OLED). To this end, the pixel circuit (PC) may include a switching transistor, a driving transistor, and at least one capacitor, which may be formed on a substrate by a process for forming a thin film transistor. The pixel circuit (PC) may be identical or similar to that of the related art pixel shown in FIG. 1, and a detailed explanation for the pixel circuit (PC) is therefore omitted.

The panel driver 200 may modulate input data (Idata) of each sub-pixel (SP) of a current frame by calculating a degradation compensation gain value to be applied to each sub-pixel (SP) on the basis of accumulated data (Adata) of each sub-pixel (SP) that may be accumulated in the memory 300 until a preceding frame prior to the current frame. The panel driver 200 may accumulate the modulated data (Mdata) of each sub-pixel (SP) from the accumulated data (Adata) of the corresponding sub-pixel (SP), and store the data obtained by accumulation in the memory 300. The panel driver 200 may convert the modulated data (Mdata) of each sub-pixel (SP) into the data voltage (Vdata), and supply the data voltage (Vdata) to each sub-pixel (SP).

The memory 300 may store the accumulated data of each sub-pixel (SP), which is accumulated by the panel driver 200 until the preceding frame prior to the current frame, in a unit of each sub-pixel (SP), and provide the accumulated data of each sub-pixel to the panel driver 200. In one embodiment, the accumulated data stored in the memory 300 may not be initialized, that is, it may be continuously accumulated while the organic light emitting display device is driven.

The panel driver 200 may include a degradation compensator 210, a timing controller 220, a gate driving circuit 230, and a data driving circuit 240.

As part of the panel driver 200, the degradation compensator 210 may modulate the input data (Idata) of each sub-pixel (SP) of the current frame by calculating the degradation compensation gain value (DCG) to be applied to each sub-pixel (SP) on the basis of accumulated data (Adata) of each sub-pixel (SP), which may be accumulated in the memory 300, may accumulate the modulated data (Mdata) of each sub-pixel (SP) from the accumulated data (Adata) of the corresponding sub-pixel (SP), and may store the data obtained by accumulation in the memory 300 and simultaneously provide the data obtained by accumulation to the timing controller 220.

The timing controller 220 may control driving timing for each of the gate driving circuit 230 and the data driving circuit 240 in accordance with a timing synchronous signal (TSS) that may be input from an external system body (not shown) or external graphics card (not shown). That is, the timing controller 220 may generate a gate control signal (GCS) and a data control signal (DCS) on the basis of the timing synchronous signal (TSS) such as a vertical synchronous signal, a horizontal synchronous signal, a data enable signal, a dot clock, etc., control the driving timing of the gate driving circuit 230 by the gate control signal (GCS), and control the driving timing of the data driving circuit 240 by the data control signal (DCS).

Also, the timing controller 220 may align pixel data (DATA) so as to make the modulated data (Mdata) of each sub-pixel (SP), supplied from the degradation compensator 210, appropriate for a pixel arrangement structure of the display panel 100, and then supply the aligned pixel data (DATA) to the data driving circuit 240 on the basis of a predetermined interface mode.

In one example, the timing controller 220 may include the degradation compensator 210 therein. In this case, the degradation compensator 210 may be provided inside the timing controller 220, wherein the degradation compensator 210 may be provided in a program or logic type.

The gate driving circuit 230 may generate the gate signal (GS) corresponding to an image-displaying order on the basis of the gate control signal (GCS) supplied from the timing controller 220, and then may supply the generated gate signal (GS) to the corresponding gate line (GL). The gate driving circuit 230 may be formed of a plurality of integrated circuits (IC), or may be directly formed on the display panel 100 during a process for forming the transistors for each sub-pixel (SP), and may be connected with one side or both sides in each of the plurality of gate lines (GL).

The data driving circuit 240 may be supplied with the pixel data (DATA) and the data control signal (DCS) from the timing controller 220, and may also supplied with a plurality of reference gamma voltages from an external reference gamma voltage supplier (not shown). The data driving circuit 240 may convert the pixel data (DATA) into the analog-type data voltage (Vdata) by the plurality of reference gamma voltages in accordance with the data control signal (DCS), and then supply the data voltage (Vdata) to the data line (DL) of the corresponding sub-pixel (SP). The data driving circuit 240 may be formed of a plurality of integrated circuits (IC), and may be connected with one side and/or both sides in each of the plurality of data lines (DL).

Figure 4:
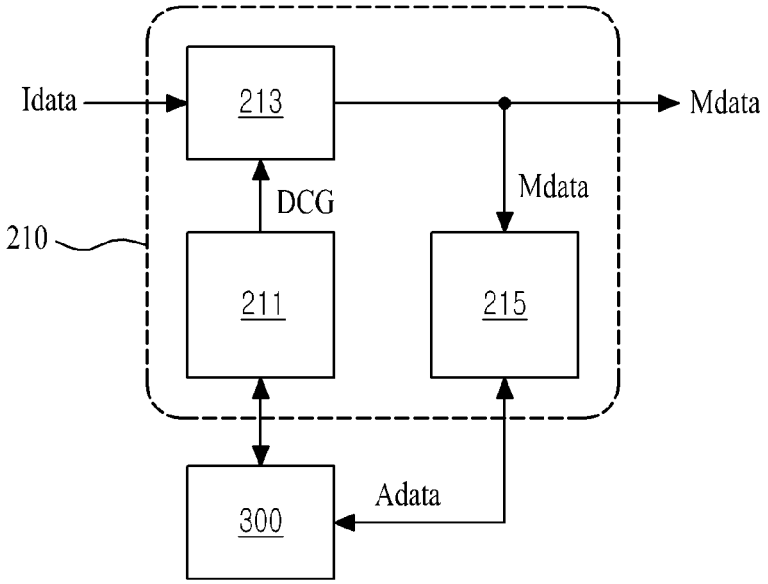
FIG. 4 is a block diagram illustrating a degradation compensator shown in FIG. 3 according to a first embodiment.
Figure 5:
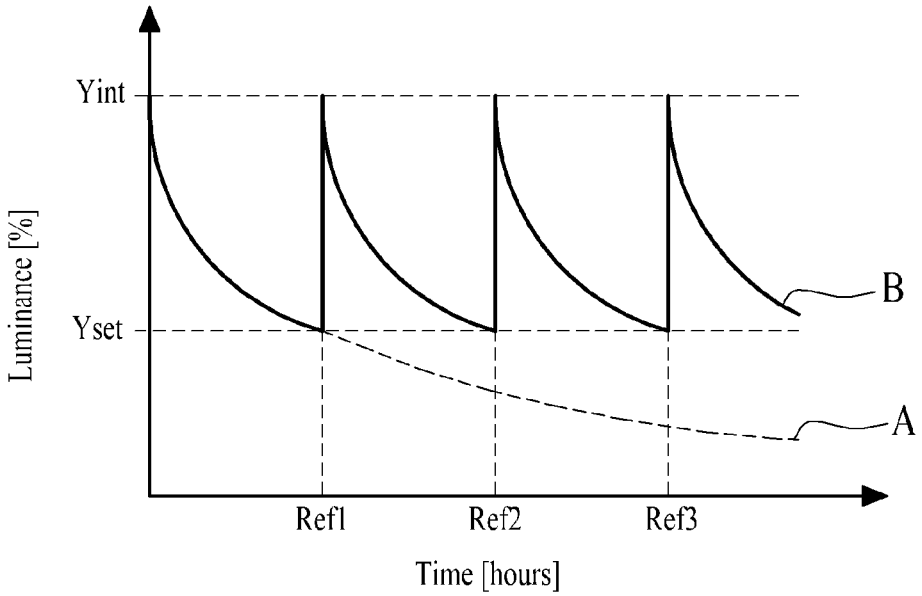
FIG. 5 is a graph illustrating luminance changes in organic light emitting diodes of the first embodiment and a first comparative example in accordance with the driving time.

FIG. 4 is a block diagram illustrating the degradation compensator, shown in FIG. 3, according to a first embodiment. FIG. 5 is a graph illustrating luminance changes in the organic light emitting diodes of the first embodiment and a first comparative example in accordance with the driving time (hours).

With reference to FIGS. 4 and 5, the degradation compensator 210 according to the first embodiment may include a degradation compensation gain value calculator 211, a data modulator 213, and a data accumulator 215.

The degradation compensation gain value calculator 211 may calculate the degradation compensation gain value (DCG) of each sub-pixel (SP) on the basis of accumulated data of the respective sub-pixels (SP) stored in the memory 300. For example, the degradation compensation gain value calculator 211 calculates the degradation compensation gain value (DCG) for increasing a luminance of each sub-pixel (SP) to a preset initial luminance (or target luminance). In one example, the degradation compensation gain value calculator 211 compares the accumulated data of the corresponding sub-pixel (SP) with compensation point accumulated data (Ref1, Ref2, Ref3). Based on the comparison result, if the accumulated data of the corresponding sub-pixel (SP) is the same as or larger than the compensation point accumulated data (Ref1, Ref2, Ref3), the degradation compensation gain value (DCG) may be calculated to increase the luminance of the corresponding sub-pixel (SP) to the preset initial luminance (or target luminance).

The compensation point accumulated data (Ref1, Ref2, Ref3) may correspond to prediction accumulated data with gradually increasing values corresponding to a luminance lowering value (Yset) which is preset with respect to the initial luminance of the organic light emitting diode (OLED). The compensation point accumulated data (Ref1, Ref2, Ref3) may be in a Look-Up Table, or relations may be provided with the prediction accumulated data for the luminance lowering point with respect to the initial luminance of the organic light emitting diode (OLED). Also, the degradation compensation gain value calculator 211 may include a Look-Up Table obtained by mapping the degradation compensation gain value (DCG) having a real number which is more than '1' in accordance with the accumulated data, or a logic operation for performing operations to derive the degradation compensation gain value (DCG) having a real number which is more than '1' in accordance with the accumulated data.

An example method for calculating the degradation compensation gain value (DCG) by the aforementioned degradation compensation gain value calculator 211 will be described as follows.

First, the degradation compensation gain value calculator 211 may compare the accumulated data of the sub-pixel (SP) with the first compensation point accumulated data (Ref1). Based on the comparison result, if the accumulated data of the sub-pixel (SP) is smaller than the first compensation point accumulated data (Ref1), the first degradation compensation gain value (DCG) having the value of '1' may be generated. Meanwhile, if the accumulated data of the sub-pixel (SP) is the same as or larger than the first compensation point accumulated data (Ref1), the first degradation compensation gain value (DCG) having the real number which is more than '1' may be generated, and simultaneously a first compensation flag may also be generated and stored. In this case, the first compensation flag may correspond to a signal indicating that the first degradation compensation for each sub-pixel (SP) is performed.

The degradation compensation gain value calculator 211 may compare the accumulated data of the sub-pixel (SP), which is continuously accumulated in accordance with the driving of each sub-pixel (SP), with the second compensation point accumulated data (Ref2) on the basis of the first compensation flag. According to the comparison result, the second degradation compensation gain value (DCG) having the real number which is more than '1' may be generated, and simultaneously a second compensation flag may be generated and stored.

As a result, the degradation compensation gain value calculator 211 may repeatedly perform the aforementioned process so as to increase the luminance of each sub-pixel (SP) to the initial luminance by generating the degradation compensation gain value (DCG) having the real number which is more than '1' whenever the accumulated data of each sub-pixel (SP) is the same as or larger than the compensation point accumulated data (Ref1, Ref2, Ref3).

The data modulator 213 may generate the modulated data (Mdata) by modulating the input data (Idata) of each sub-pixel (SP), which may be input from the external system body (not shown) or graphics card (not shown), based on the degradation compensation gain value (DCG) of each sub-pixel (SP) supplied from the degradation compensation gain value calculator 211. For example, the data modulator 213 may generate the modulated data (Mdata) by multiplying the input data (Idata) and the corresponding degradation compensation gain value (DCG), but embodiments are not limited to this method. The modulated data (Mdata) may, for example, be generated by any one of the four fundamental arithmetic operations of addition, subtraction, multiplication, and division.

The data accumulator 215 may read the accumulated data of each sub-pixel (SP) stored in the memory 300, accumulate the modulated data (Mdata) of the corresponding sub-pixel (SP) outputted from the data modulator 213 when reading accumulated data of the sub-pixel (SP); and again store the accumulated data (Adata) of each sub-pixel (SP) accumulated until to the current frame in the memory 300. In this case, the data accumulator 215 may accumulate the modulated data (Mdata) of each sub-pixel (SP) at every frame or every predetermined number of plural frames. Accordingly, the accumulated data (Adata) of each sub-pixel (SP) stored in the memory 300 may be used as reference data for modulating each sub-pixel (SP) of the next frame. Also, the accumulated data (Adata) of each sub-pixel (SP) stored in the memory 300 may not be initialized—that is, it may be continuously accumulated while the organic light emitting display device is driven.

With reference to FIG. 5, the 'A' plot shows luminance change in accordance with the driving time of the sub-pixel in the first comparative example to which the aforementioned degradation compensation gain value (DCG) is not applied, and the 'B' plot shows luminance change in accordance with the driving time of the sub-pixel in the first embodiment to which the aforementioned degradation compensation gain value (DCG) is applied.

As shown in plot 'A', in the first comparative example, as the organic light emitting diode is degraded in accordance with the driving time, the luminance may gradually decrease from the initial luminance in accordance with the increase of driving time.

Meanwhile, as shown in plot 'B', in the first embodiment, whenever the accumulated data of each sub-pixel (SP) is the same as or larger than the compensation point accumulated data (Ref1, Ref2, Ref3), the degradation compensation gain value (DCG) may be applied so that the luminance of the sub-pixel (SP) may be increased to the initial luminance (Yint).

The organic light emitting display device including the degradation compensator 210 according to the first embodiment may compensate the luminance of each sub-pixel (SP) to the initial luminance by applying the degradation compensation gain value (DCG), thereby displaying high-luminance images for a long time.

Figure 6:
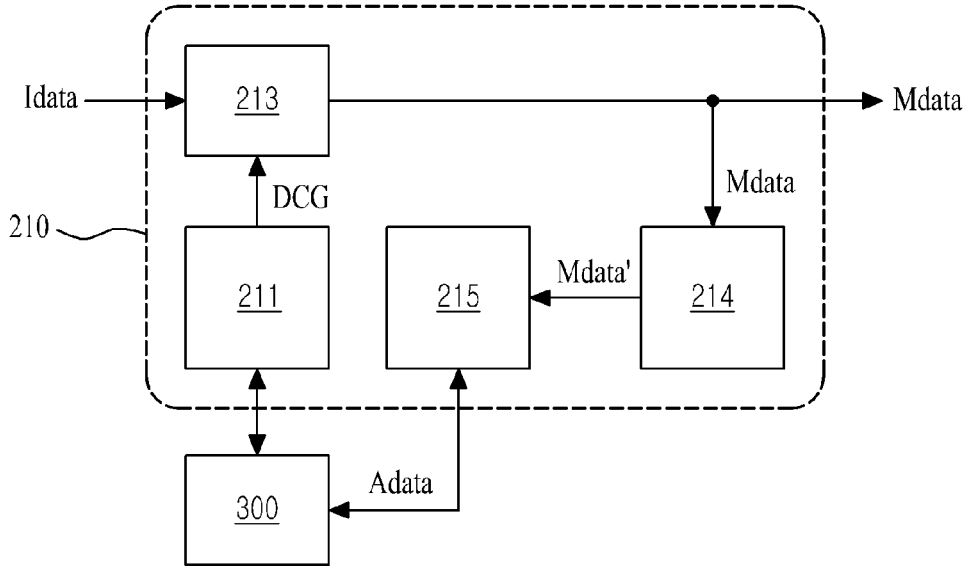
FIG. 6 is a block diagram illustrating a degradation compensator shown in FIG. 3 according to a second embodiment.

FIG. 6 is a block diagram illustrating the degradation compensator, shown in FIG. 3, according to a second embodiment.

With reference to FIG. 6, the degradation compensator 210 according to the second embodiment may include a degradation compensation gain value calculator 211, a data modulator 213, a degradation weight reflector 214, and a data accumulator 215. Except for the degradation weight reflector 214, the degradation compensator 210 according to the second embodiment may be identical or similar in structure to the degradation compensator of FIGS. 4 and 5 (e.g., according to the first embodiment), and a detailed explanation for the same or similar parts is therefore omitted.

The degradation weight reflector 214 may calculate a degradation weight by analyzing a grayscale value of modulated data (Mdata) of each sub-pixel (SP) outputted from the data modulator 213, reflect the calculated degradation weight in the modulated data (Mdata) of the corresponding sub-pixel (SP) so as to correct the modulated data, and supply the corrected modulated data (Mdata') to the data accumulator 215. In this case, the degradation weight of each sub-pixel (SP) may be set to make the same degradation level (or degradation characteristics) in the organic light emitting diodes (OLED) having the same accumulated data on the basis of the degradation characteristics of the organic light emitting diode (OLED), that is, the non-linear degradation characteristics of the organic light emitting diode (OLED) by the electrical stress.

For example, the organic light emitting diode (OLED) may be degraded by the electrical stress, wherein the electrical stress may be proportional to the size of input data. However, the degradation of the organic light emitting diode (OLED) according to the accumulated data may have non-linear characteristics.

Figure 7:
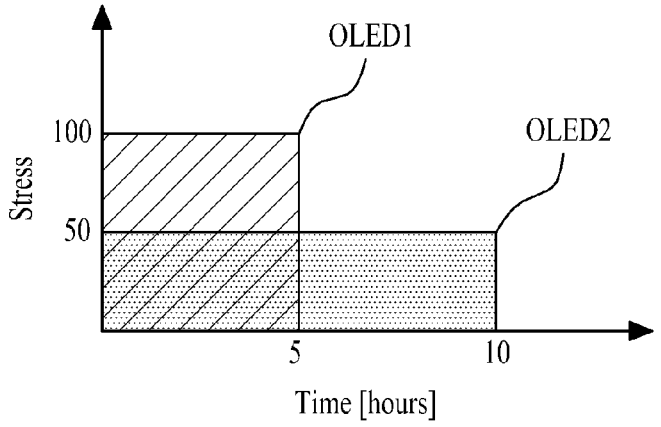
FIG. 7 illustrates the degradation characteristics of an organic light emitting diode in accordance with electrical stress.
Figure 8:
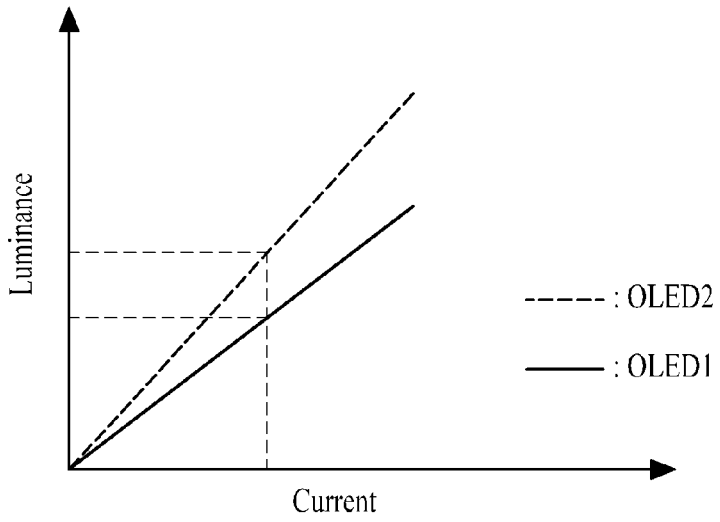
FIG. 8 illustrates a luminance deviation in accordance with the degradation characteristics of the organic light emitting diode according to the related art.

In other words, if applying different data to the organic light emitting diodes (OLED) for a preset time period under the condition that an integral value (or accumulated data value) for the time of data applied to the organic light emitting diode (OLED) for a preset time period is identically applied, the degradation of the organic light emitting diode (OLED) may vary. For example, as shown in FIG. 7, suppose that the stress of '100' is applied to the first organic light emitting diode (OLED1) for 5 hours, and the stress of '50' is applied to the second light emitting diode (OLED2) for 10 hours. Even though the first and second organic light emitting diodes (OLED1, OLED2) have the same accumulated stress value, a degradation level of the first organic light emitting diode (OLED1) may be larger than a degradation level of the second organic light emitting diode (OLED2). Accordingly, as shown in FIG. 8, when the same current is applied to each of the first and second organic light emitting diodes (OLED1, OLED2), a luminance of the first organic light emitting diode (OLED1) may be lower than a luminance of the second light emitting diode (OLED2). Thus, in order to realize uniform luminance in the first and second organic light emitting diodes (OLED1, OLED2), the degradation weight reflector 214 may calculate the different degradation weights in accordance to a grayscale value of data to be applied to the first organic light emitting diode (OLED1) and a grayscale value of data to be applied to the second organic light emitting diode (OLED2), and may reflect the calculated degradation weights in the input data.

Eventually, the degradation weight reflector 214 may generate the degradation weight having a real number between '0' and '1' in accordance with the grayscale value of the input data. That is, the degradation weight reflector 214 may calculate the degradation weight having the value of '1' when the input data is 8 bits and the grayscale value of the input data is '255'. As the grayscale value of the input data becomes smaller, the calculated degradation weight becomes smaller.

The degradation weight reflector 214 may include a Look-Up Table (not shown) obtained by mapping the degradation weight in accordance with the grayscale value of the data through a pretest based on the luminance characteristics for the current of the organic light emitting diode (OLED), or operation logic (not shown) to derive the degradation weight in accordance with the grayscale value of the data; and a data corrector (not shown) for reflecting the degradation weight in the modulated data (Mdata) so as to correct the modulated data (Mdata).

With reference once again to FIG. 6, the data accumulator 215 may read the accumulated data of the sub-pixel (SP) stored in the memory 300; accumulate the corrected modulated data (Mdata') supplied from the degradation weight reflector 214 when reading the accumulated data of the sub-pixel (SP), and again may store the accumulated data (Adata) of each sub-pixel (SP) accumulated until the current frame in the memory 300. In this case, the data accumulator 215 may accumulate the corrected modulated data (Mdata') of each sub-pixel (SP) every frame or every predetermined number of plural frames. Accordingly, the accumulated data (Adata) of each sub-pixel (SP) stored in the memory 300 may be used as reference data for modulating each sub-pixel (SP) of the next frame.

The organic light emitting display device including the degradation compensator 210 according to the second embodiment may compensate the luminance of each sub-pixel (SP) to the initial luminance by reflecting the degradation weight based on the non-linear degradation characteristics of the organic light emitting diode (OLED) in the accumulated data, to thereby display high-luminance images for a long time, and to improve precision in compensating the degradation of the organic light emitting diode (OLED).

Figure 9:
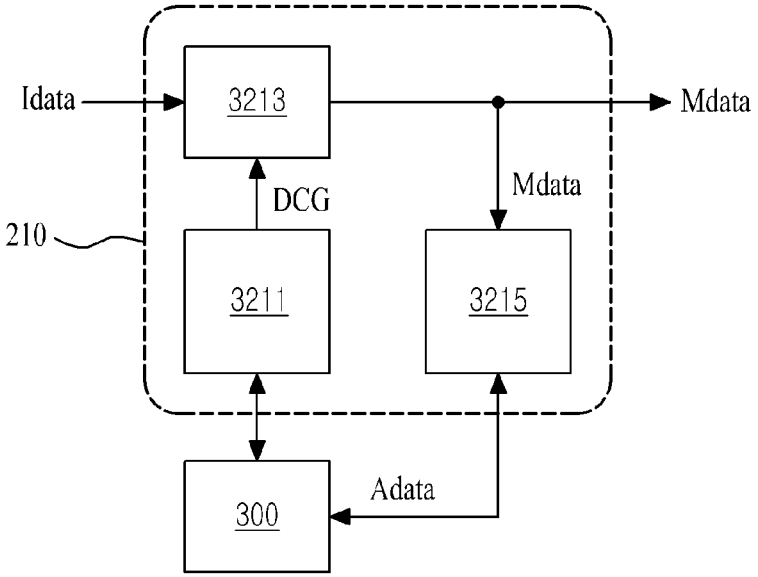
FIG. 9 is a block diagram illustrating a degradation compensator shown in FIG. 3 according to a third embodiment.
Figure 10:
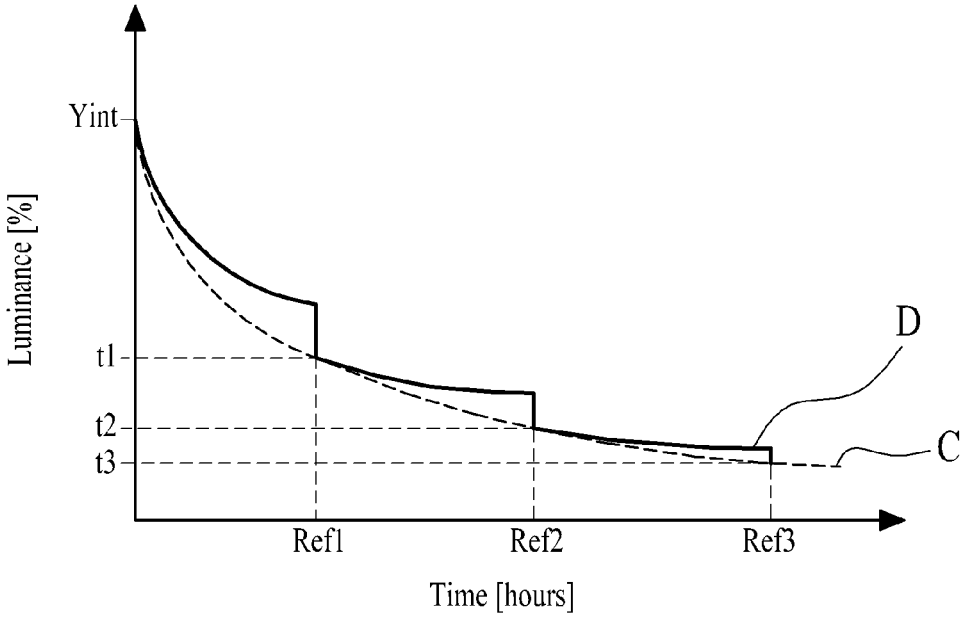
FIG. 10 is a graph illustrating luminance changes in accordance with driving time of a sub-pixel in the organic light emitting display device according to an embodiment.

FIG. 9 is a block diagram illustrating the degradation compensator, shown in FIG. 3, according to a third embodiment. FIG. 10 is a graph illustrating luminance changes in accordance with the driving time of sub-pixel (SP) in the organic light emitting display device of the embodiment.

With reference to FIGS. 9 and 10, the degradation compensator 210 according to the third embodiment may include a degradation compensation gain value calculator 3211, a data modulator 3213, and a data accumulator 3215.

The degradation compensation gain value calculator 3211 may calculate the degradation compensation gain value (DCG) of each sub-pixel (SP) on the basis of accumulated data of the respective sub-pixels (SP) stored in the memory 300. In this case, the degradation compensation gain value calculator 3211 may calculate the degradation compensation gain value (DCG) for decreasing a luminance of each sub-pixel (SP) to a luminance of the sub-pixel (SP) having the organic light emitting diode (OLED) that is most degraded.

For example, the degradation compensation gain value calculator 3211 may extract the maximum accumulated data with the maximum value from the accumulated data of all the sub-pixels (SP) stored in the memory 300, compare the extracted maximum accumulated data with the compensation point accumulated data (Ref1, Ref2, Ref3), and accumulate the degradation compensation gain value (DCG) of each sub-pixel (SP) on the basis of the difference value between the maximum accumulated data and the accumulated data of each sub-pixel (SP) if the maximum accumulated data is the same as or larger than the compensation point accumulated data (Ref1, Ref2, Ref3).

According to another example, the degradation compensation gain value calculator 3211 may compare the accumulated data of the corresponding sub-pixel (SP) with the compensation point accumulated data (Ref1, Ref2, Ref3), and may calculate the degradation compensation gain value (DCG) of each sub-pixel (SP) on the basis of the difference value between the maximum accumulated data and the accumulated data of each sub-pixel (SP) if the accumulated data of the corresponding sub-pixel (SP) is the same as or larger than the compensation point accumulated data (Ref1, Ref2, Ref3).

The compensation point accumulated data (Ref1, Ref2, Ref3) may correspond to prediction accumulated data that corresponds to luminance lowering points (t1, t2, t3) with respect to the initial luminance of the organic light emitting diode (OLED), where the luminance lowering points may be set as a Look-Up Table or as relations to derive the prediction accumulated data for the luminance lowering point with respect to the initial luminance of the organic light emitting diode (OLED). The degradation compensation gain value calculator 3211 may include a Look-Up Table obtained by mapping the degradation compensation gain value (DCG) having a real number which is less than '1' in accordance with the difference value between the maximum accumulated data and the accumulated data, or a logic operation for performing operations to derive the degradation compensation gain value (DCG) having a real number which is less than '1' in accordance with the difference value between the accumulated data and the maximum accumulated data.

An example method for calculating the degradation compensation gain value (DCG) by the aforementioned degradation compensation gain value calculator 3211 will be described as follows.

First, the degradation compensation gain value calculator 3211 may extract the maximum accumulated data with the maximum value from the accumulated data of all the sub-pixels (SP) stored in the memory 300, and may set the degradation compensation reference data by the use of extracted maximum accumulated data.

Then, the degradation compensation reference data may be compared with the first compensation point accumulated data (Ref1). Based on the comparison result, if the degradation compensation reference data is smaller than the first compensation point accumulated data (Ref1), the first degradation compensation gain value (DCG) having the value of '1' may be generated. Meanwhile, if the degradation compensation reference data is the same as or larger than the first compensation point accumulated data (Ref1), the degradation compensation gain value calculator 3211 may generate the first degradation compensation gain value (DCG) having the real number which is less than '1' in accordance with the difference value between the degradation compensation reference data and the accumulated data of the sub-pixel (SP), and simultaneously generate a first compensation flag. In this case, the degradation compensation gain value calculator 3211 may generate the first degradation compensation gain value (DCG) with the value of '1' for the sub-pixel (SP) which has the same accumulated data as the degradation compensation reference data.

Then, the degradation compensation gain value calculator 3211 may reset the aforementioned degradation compensation reference data from the accumulated data of the sub-pixel (SP) which is continuously accumulated in accordance with the driving of each sub-pixel (SP) on the basis of the first compensation flag, compare the reset degradation compensation reference data with the second compensation point accumulated data (Ref2), and generate the second degradation compensation gain value (DCG) of each sub-pixel (SP) having the real number which is less than '1' based on the comparison result, and simultaneously generate a second compensation flag.

Eventually, the degradation compensation gain value calculator 3211 may repeatedly perform the aforementioned process so as to make the luminance (D) of each sub-pixel (SP) be equal to the luminance (C) of the sub-pixel (SP) having the degradation compensation reference data by generating the degradation compensation gain value (DCG) of each sub-pixel (SP) having the real number which is less than '1' in accordance with the difference value between the degradation compensation reference data and the accumulated data of the sub-pixel (SP) whenever the degradation compensation reference data is the same as or larger than the compensation point accumulated data (Ref1, Ref2, Ref3).

The data modulator 3213 may generate the modulated data (Mdata) by modulating the input data (Idata) of each sub-pixel (SP), which may be input from the external system body (not shown) or graphics card (not shown), based on the degradation compensation gain value (DCG) of each sub-pixel (SP) supplied from the degradation compensation gain value calculator 211. For example, the data modulator 3213 may generate the modulated data (Mdata) by multiplying the input data (Idata) and the corresponding degradation compensation gain value (DCG), but not limited to this method. That is, the modulated data (Mdata) may be generated by, for example, any one of the four fundamental arithmetic operations of addition, subtraction, multiplication, and division.

The data accumulator 3215 may read the accumulated data of each sub-pixel (SP) stored in the memory 300, accumulate the modulated data (Mdata) of the corresponding sub-pixel (SP) outputted from the data modulator 3213 when reading accumulated data of the sub-pixel (SP), and again store the accumulated data (Adata) of each sub-pixel (SP) accumulated until the current frame in the memory 300. In this case, the data accumulator 3215 may accumulate the modulated data (Mdata) of each sub-pixel (SP) at every frame or every predetermined number of plural frames. Accordingly, the accumulated data (Adata) of each sub-pixel (SP) stored in the memory 300 may be used as reference data for modulating each sub-pixel (SP) of the next frame.

In FIG. 10, the 'C' plot shows a luminance change in accordance with the driving time of the reference sub-pixel having the maximum accumulated data, and the 'D' plot shows the luminance change in accordance with the driving time of the remaining sub-pixels except for the reference sub-pixel.

As shown in FIG. 10, the aforementioned degradation compensation gain value (DCG) may be calculated based on the difference value of accumulated data between the reference sub-pixel having the maximum accumulated data and the sub-pixel having the other accumulated data at every predetermined luminance lowering point (t1, t2, t3) of each sub-pixel, whereby the luminance (D) of each sub-pixel (SP) may be adjusted to be identical to the luminance (C) of the reference sub-pixel having the maximum accumulated data.

The organic light emitting display device including the degradation compensator 210 according to the third embodiment may lower the luminance of each sub-pixel (SP) by applying the degradation compensation gain value (DCG), so that it may be possible to decrease the electrical stress applied to the organic light emitting diode (OLED) of each sub-pixel (SP), to thereby delay the degradation of the organic light emitting diode (OLED), and increase the lifespan of the organic light emitting diode (OLED).

Meanwhile, the degradation compensator 210 according to the third embodiment may further include the degradation weight reflector 214 shown in FIG. 6. In this case, the degradation weight reflector 214 may reflect the corresponding degradation weight in the modulated data (Mdata) of each sub-pixel (SP) outputted from the data modulator 3213, and the data accumulator 3215 may accumulate (a) the modulated data (Mdata') in which the degradation weight is reflected, and (b) the corresponding accumulated data, and then may store the accumulated data in the memory 300.

Figure 11:
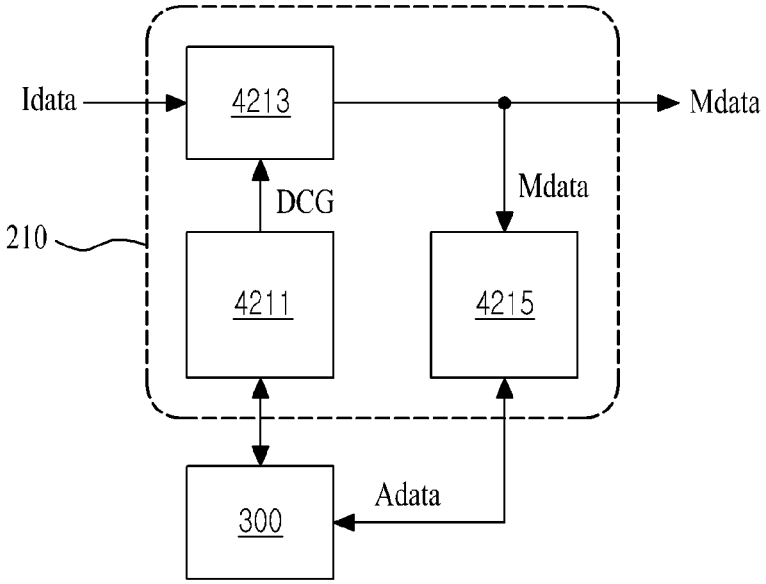
FIG. 11 is a block diagram illustrating a degradation compensator shown in FIG. 3 according to a fourth embodiment.
Figure 12:
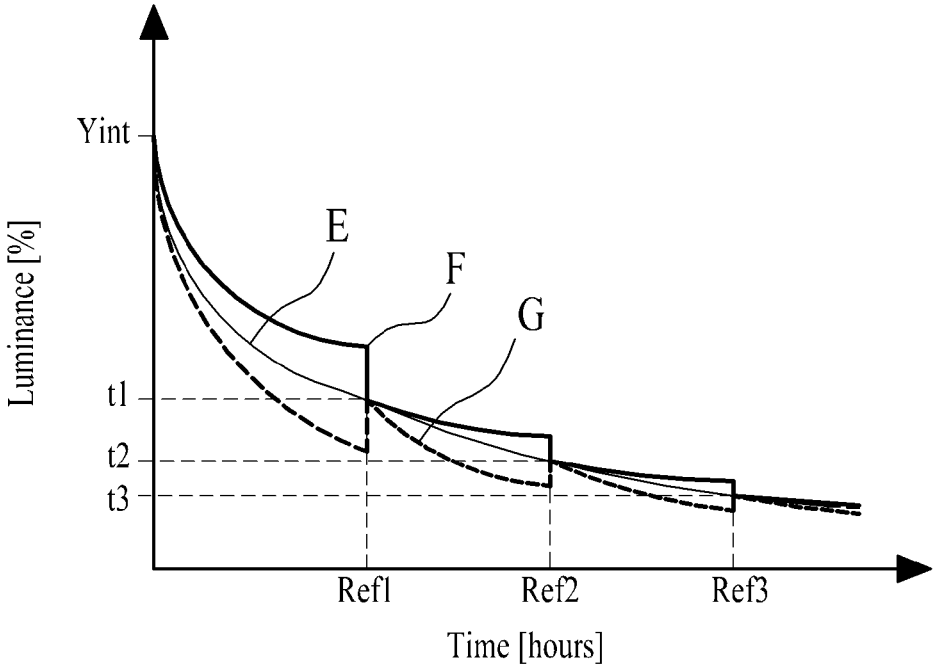
FIG. 12 is a graph illustrating luminance changes in accordance with driving time of a sub-pixel in the organic light emitting display device according to an embodiment.

FIG. 11 is a block diagram illustrating the degradation compensator, shown in FIG. 3, according to a fourth embodiment. FIG. 12 is a graph illustrating luminance changes of sub-pixels in accordance with the driving time (hours).

With reference to FIGS. 11 and 12, the degradation compensator 210 according to the fourth embodiment may include a degradation compensation gain value calculator 4211, a data modulator 4213, and a data accumulator 4215.

The degradation compensation gain value calculator 4211 may calculate the degradation compensation gain value (DCG) of each sub-pixel (SP) on the basis of accumulated data of the respective sub-pixels (SP) stored in the memory 300. In this case, the degradation compensation gain value calculator 4211 may calculate the degradation compensation gain value (DCG) for adjusting a luminance of each sub-pixel (SP) to a luminance of the sub-pixel (SP) having the organic light emitting diode (OLED) which is degraded at a mean (average) level among all the sub-pixel (SP). For example, the degradation compensation gain value calculator 4211 may calculate mean accumulated data between the maximum accumulated data having the maximum value and the minimum accumulated data having the minimum value from the accumulated data of the sub-pixels (SP) stored in the memory 300, or the average accumulated data for the accumulated data of all the sub-pixels (SP); may set degradation compensation reference data by the use of mean accumulated data or average accumulated data; may compare the degradation compensation reference data with the plurality of compensation point accumulated data (Ref1, Ref2, Ref3); and may calculate the degradation compensation gain value (DCG) of each sub-pixel on the basis of the difference value between the degradation compensation reference data and the accumulated data of each sub-pixel (SP) if the degradation compensation reference data is the same as or larger than the compensation point accumulated data (Ref1, Ref2, Ref3).

The compensation point accumulated data (Ref1, Ref2, Ref3) may correspond to prediction accumulated data that corresponds to luminance lowering points (t1, t2, t3) with respect to the initial luminance of the organic light emitting diode (OLED), which may be provided as a Look-Up Table or as relations to derive the prediction accumulated data for the luminance lowering point with respect to the initial luminance of the organic light emitting diode (OLED). The degradation compensation gain value calculator 4211 may include a Look-Up Table obtained by mapping the degradation compensation gain value (DCG) having a real number which is less or more than '1' in accordance with the difference value between the degradation compensation reference data and the accumulated data, or by a logic operation for performing operations to derive the degradation compensation gain value (DCG) having a real number which is less or more than '1' in accordance with the difference value between the degradation compensation reference data and the accumulated data.

An example method for calculating the degradation compensation gain value (DCG) by the aforementioned degradation compensation gain value calculator 4211 will be described as follows.

First, the degradation compensation gain value calculator 4211 may set the degradation compensation reference data by the use of mean accumulated data between the maximum accumulated data having the maximum value and the minimum accumulated data having the minimum value from the accumulated data of the sub-pixels (SP) stored in the memory 300, or by the use of average accumulated data for the accumulated data of all the sub-pixels (SP).

Then, the degradation compensation gain value calculator 4211 may compare the degradation compensation reference data with the compensation point accumulated data (Ref1, Ref2, Ref3), and may generate the first degradation compensation gain value (DCG) having the value of '1' if the degradation compensation reference data is smaller than the first compensation point accumulated data (Ref1).

Meanwhile, the degradation compensation gain value calculator 4211 may generate the first degradation compensation gain value (DCG) having the real number which is less or more than '1' on the basis of the difference value between the degradation compensation reference data and the accumulated data of each sub-pixel (SP), and may simultaneously generate and store a first compensation flag if the degradation compensation reference data is the same as or larger than the first compensation point accumulated data (Ref1). In this case, the degradation compensation gain value calculator 4211 may generate the first degradation compensation gain value (DCG) having a real number which is less than '1' for the sub-pixel (SP) having the accumulated data which is smaller than the degradation compensation reference data, and may generate the first degradation compensation gain value (DCG) having a real number which is more than '1' for the sub-pixel (SP) having the accumulated data which is larger than the degradation compensation reference data. The degradation compensation gain value calculator 4211 may generate the first degradation compensation gain value (DCG) having the value of '1' for the sub-pixel (SP) having the accumulated data which is the same as the degradation compensation reference data.

Then, the degradation compensation gain value calculator 4211 resets the aforementioned degradation compensation reference data from the accumulated data of the sub-pixel (SP) which may be continuously accumulated by the driving of each sub-pixel (SP) on the basis of the first compensation flag, and may compare the reset degradation compensation reference data with the second compensation point accumulated data (Ref2). Based on the comparison result, the degradation compensation gain value calculator 4211 may generate the second compensation gain value (DCG) of each sub-pixel (SP) having a real number which is less or more than '1', and may simultaneously generate and store a second compensation flag.

Eventually, the degradation compensation gain value calculator 4211 may repeatedly perform the aforementioned process so as to make the luminance (F, G) of each sub-pixel (SP) identical to the luminance (E) of the reference sub-pixel (SP) having the degradation compensation reference data, by way of generating the degradation compensation gain value (DCG) of each sub-pixel (SP) having a real number which is less or more than '1' in accordance with the difference value between the degradation compensation reference data and the accumulated data of each sub-pixel (SP) whenever the degradation compensation reference data is the same as or larger than the compensation point accumulated data (Ref1, Ref2, Ref3).

The data modulator 4213 may generate the modulated data (Mdata) by modulating the input data (Idata) of each sub-pixel (SP), which may be input from the external system body (not shown) or graphics card (not shown), based on the degradation compensation gain value (DCG) of each sub-pixel (SP) supplied from the degradation compensation gain value calculator 4211. For example, the data modulator 4213 may generate the modulated data (Mdata) by multiplying the input data (Idata) and the corresponding degradation compensation gain value (DCG), but embodiments are not limited to this method. The modulated data (Mdata) may be generated by, for example, any one of the four fundamental arithmetic operations of as addition, subtraction, multiplication, and division.

The data accumulator 4215 may read the accumulated data of the sub-pixel (SP) stored in the memory 300, accumulate the modulated data (Mdata) of the corresponding sub-pixel (SP) outputted from the data modulator 4213 when reading accumulated data of the sub-pixel (SP), and again store the accumulated data (Adata) of each sub-pixel (SP) accumulated until the current frame in the memory 300. In this case, the data accumulator 4215 may accumulate the modulated data (Mdata) of each sub-pixel (SP) at every frame or at every predetermined number of plural frames. Accordingly, the accumulated data (Adata) of each sub-pixel (SP) stored in the memory 300 may be used as reference data for modulating each sub-pixel (SP) of the next frame.

In FIG. 12, the 'E' plot shows luminance change in accordance with the driving time of the reference sub-pixel having the aforementioned degradation compensation reference data; the 'F' plot shows luminance change in accordance with the driving time of the sub-pixel having the accumulated data which is smaller than the degradation compensation reference data, and the 'G' plot shows luminance change in accordance with the driving time of the sub-pixel having the accumulated data which is larger than the degradation compensation reference data.

As shown in FIG. 12, the aforementioned degradation compensation gain value (DCG) may be calculated based on the difference value of accumulated data between the reference sub-pixel having the degradation compensation reference data and the other sub-pixel having the other accumulated data at every predetermined luminance lowering point (t1, t2, t3) of each sub-pixel, whereby the luminance (F, G) of each sub-pixel (SP) may be adjusted to be identical to the luminance (E) of the reference sub-pixel having the degradation compensation reference data. That is, the luminance may be adjusted in such a way that the luminance (F) of the sub-pixel (SP) having the accumulated data which is smaller than the degradation compensation reference data is decreased to be identical to the luminance (E) of the reference sub-pixel having the degradation compensation reference data, and the luminance (G) of the sub-pixel (SP) having the accumulated data which is larger than the degradation compensation reference data is increased to be identical to the luminance (E) of the reference sub-pixel having the degradation compensation reference data.

The organic light emitting display device including the degradation compensator 210 according to the fourth embodiment may enable the luminance of each sub-pixel (SP) to be identical to the mean (or average) luminance of the all sub-pixels (SP) by applying the degradation compensation gain value (DCG), so that it may be possible to decrease the electrical stress applied to the organic light emitting diode (OLED) of each sub-pixel (SP), thereby delaying the degradation of the organic light emitting diode (OLED) and increasing the lifespan of the organic light emitting diode (OLED).

The degradation compensator 210 according to the fourth embodiment may further include the aforementioned degradation weight reflector 214 shown in FIG. 6. In this case, the degradation weight reflector 214 may reflect the corresponding degradation weight in the modulated data (Mdata) of each sub-pixel (SP) outputted from the data modulator 4213, and the data accumulator 4215 may accumulate the modulated data (Mdata') in which the degradation weight is reflected and the corresponding accumulated data, and then store the accumulated data in the memory 300.

According to the embodiments, the organic light emitting display device and the method for driving the same may modulate the data to be supplied to each sub-pixel (SP) based on the accumulated data of each sub-pixel (SP), thereby decreasing the lowering of luminance and the luminance deviation caused by the degradation of the organic light emitting diode (OLED) of each sub-pixel (SP). This thereby decreases the residual image caused by the luminance deviation and increases the lifespan of the organic light emitting diode (OLED).

It will be apparent to those skilled in the art that various modifications and variations can be made in the present embodiments without departing from the spirit or scope of the inventions. Thus, it is intended that the present invention covers the modifications and variations of the embodiments provided they come within the scope of the appended claims and their equivalents.

What is claimed is:

1. An organic light emitting display device comprising:

a display panel configured to include a plurality of sub-pixels including an organic light emitting diode which emits light with a data current based on a data voltage;

a memory configured to accumulate and store data displayed by each of the plurality of sub-pixels, the accumulated data of each sub-pixel stored in the memory including data of a preceding frame;

a deterioration compensation gain value calculator configured to:

set a plurality of deterioration compensation points and a reference value for each of the plurality of deterioration compensation points, wherein the reference values correspond to values of the accumulated data, and calculate a deterioration compensation gain value of each sub-pixel at every deterioration compensation point, based on the reference value for each deterioration compensation point and the accumulated data of each sub-pixel stored in the memory;

a data modulator configured to reflect the deterioration compensation gain value in input data, which is to be supplied to each sub-pixel, to generate modulated data;

a data accumulator configured to convert the modulated data into the data voltage, and accumulate the modulated data in accumulated data of a corresponding sub-pixel; and a deterioration weight reflector configured to calculate a deterioration weight by analyzing a grayscale value of the modulated data of each sub-pixel outputted from the data modulator, and reflect the calculated deterioration weight in modulated data of a corresponding sub-pixel to correct the modulated data, wherein the data accumulator accumulates the corrected modulated data in accumulated data of the corresponding sub-pixel.

2. The organic light emitting display device of claim 1, wherein the deterioration compensation gain value calculator calculates a deterioration compensation gain value for increasing a luminance of each sub-pixel to an initial luminance at every deterioration compensation point.

3. The organic light emitting display device of claim 1, wherein, when the accumulated data of each sub-pixel is equal to or greater than the reference value, the deterioration compensation gain value calculator calculates the deterioration compensation gain value of each sub-pixel.

4. The organic light emitting display device of claim 1, wherein the deterioration compensation gain value calculator selects a maximum value from among the accumulated data of all the plurality of sub-pixels stored in the memory, and calculates a deterioration compensation gain value for decreasing a luminance of each sub-pixel to a luminance of a sub-pixel having the maximum value, at every deterioration compensation point.

5. The organic light emitting display device of claim 4, wherein, when the maximum value is equal to or greater than the reference value, the deterioration compensation gain value calculator calculates the deterioration compensation gain value of each sub-pixel, based on a difference value between the maximum value and the accumulated data of each sub-pixel.

6. The organic light emitting display device of claim 1, wherein the deterioration compensation gain value calculator calculates deterioration compensation reference data by using the accumulated data of each sub-pixel stored in the memory, and calculates a deterioration compensation gain value for increasing or decreasing a luminance of each sub-pixel to a luminance of a sub-pixel having the deterioration compensation reference data, at every deterioration compensation point.

7. The organic light emitting display device of claim 6, wherein, the deterioration compensation gain value calculator calculates, as the deterioration compensation reference data, a mean value of a maximum value and a minimum value among the accumulated data of all the plurality of sub-pixels or an average value of the accumulated data of all the plurality of sub-pixels, and when the deterioration compensation reference data is equal to or greater than the reference value, the deterioration compensation gain value calculator calculates a deterioration compensation gain value of each sub-pixel, based on a difference value between the deterioration compensation reference data and the accumulated data of each sub-pixel.

8. The organic light emitting display device of claim 7, wherein, when the accumulated data of each sub-pixel is less than the deterioration compensation reference data, the deterioration compensation gain value calculator calculates a deterioration compensation gain value having a real number value less than one, and when the accumulated data of each sub-pixel is greater than the deterioration compensation reference data, the deterioration compensation gain value calculator calculates a deterioration compensation gain value having a real number value equal to or more than one.

9. The organic light emitting display device of claim 1, wherein the deterioration weight reflector differently sets the deterioration weight according to a grayscale value of the modulated data so that deterioration characteristics of sub-pixels having the same accumulated data are the same.

10. A method of driving an organic light emitting display device including a display panel which includes a plurality of sub-pixels including an organic light emitting diode which emits light with a data current based on a data voltage, the method comprising:

accumulating and storing, in a memory, data displayed by each of the plurality of sub-pixels, the accumulated data of each sub-pixel stored in the memory including data of a preceding frame;

setting a plurality of deterioration compensation points and a reference value for each of the plurality of deterioration compensation points, wherein the reference values correspond to values of the accumulated data;

calculating a deterioration compensation gain value of each sub-pixel at every deterioration compensation point, based on the reference value for each deterioration compensation point and the accumulated data of each sub-pixel stored in the memory;

reflecting the deterioration compensation gain value in input data, which is to be supplied to each sub-pixel, to generate modulated data;

accumulating the modulated data of each sub-pixel in accumulated data of a corresponding sub-pixel;

converting the modulated data of each sub-pixel into the data voltage to supply the data voltage to each sub-pixel;

calculating a deterioration weight by analyzing a grayscale value of the modulated data of each sub-pixel; and reflecting the calculated deterioration weight in modulated data of a corresponding sub-pixel to correct the modulated data, wherein the corrected modulated data and accumulated data of the corresponding sub-pixel are accumulated and stored in the memory.

11. The method of claim 10, wherein the calculating of the deterioration compensation gain value comprises calculating a deterioration compensation gain value for increasing a luminance of each sub-pixel to an initial luminance at every deterioration compensation point.

12. The method of claim 10, wherein the calculating of the deterioration compensation gain value comprises, when the accumulated data of each sub-pixel is equal to or greater than the reference value, calculating the deterioration compensation gain value of each sub-pixel.

13. The method of claim 10, wherein the calculating of the deterioration compensation gain value comprises:

selecting a maximum value from among the accumulated data of all the plurality of sub-pixels stored in the memory at every deterioration compensation point; and calculating a deterioration compensation gain value for decreasing a luminance of each sub-pixel to a luminance of a sub-pixel having the maximum value.

14. The method of claim 13, wherein the calculating of the deterioration compensation gain value comprises, when the maximum value is equal to or greater than the reference value, calculating the deterioration compensation gain value of each sub-pixel, based on a difference value between the maximum value and the accumulated data of each sub-pixel.

15. The method of claim 10, wherein the calculating of the deterioration compensation gain value comprises:

calculating deterioration compensation reference data by using the accumulated data of each sub-pixel stored in the memory at every deterioration compensation point; and calculating a deterioration compensation gain value for increasing or decreasing a luminance of each sub-pixel to a luminance of a sub-pixel having the deterioration compensation reference data.

16. The method of claim 15, wherein the calculating of the deterioration compensation gain value comprises:

calculating, as the deterioration compensation reference data, a mean value of a maximum value and a minimum value among the accumulated data of all the plurality of sub-pixels or an average value of the accumulated data of all the plurality of sub-pixels; and when the deterioration compensation reference data is equal to or greater than the reference value, calculating a deterioration compensation gain value of each sub-pixel, based on a difference value between the deterioration compensation reference data and the accumulated data of each sub-pixel.

17. The method of claim 16, wherein the calculating of the deterioration compensation gain value further comprises:

when the accumulated data of each sub-pixel is less than the deterioration compensation reference data, calculating a deterioration compensation gain value having a real number value less than one, and when the accumulated data of each sub-pixel is greater than the deterioration compensation reference data, calculating a deterioration compensation gain value having a real number value equal to or more than one.

18. The method of claim 10, wherein the calculating of the deterioration weight differently setting the deterioration weight according to a grayscale value of the modulated data so that deterioration characteristics of sub-pixels having the same accumulated data are the same.

* * * * *